US005499638A

United States Patent [19]

Ripley

[11] Patent Number: 5,499,638

[45] Date of Patent: Mar. 19, 1996

[54] HAIR HOLDING DEVICE

[76] Inventor: Jamie R. Ripley, 19645 Detroit Rd., Apartment 281, Rocky River, Ohio 44116

[21] Appl. No.: 324,768

[22] Filed: Oct. 17, 1994

[51] Int. Cl.[6] ..... A45D 8/14; A45D 2/18

[52] U.S. Cl. ..... 132/273; 132/246; 28/41

[58] Field of Search ..... 132/273, 275, 132/246, 247, 245; D28/39, 41, 40

[56] References Cited

U.S. PATENT DOCUMENTS

| | | | |
|---|---|---|---|
| 1,163,343 | 12/1915 | Illoway | 132/246 |
| 1,465,216 | 8/1923 | Heathcote | 132/246 |
| 1,512,490 | 10/1924 | Scheanblum et al. | 132/246 |
| 1,592,688 | 12/1925 | Webster . | |
| 1,619,743 | 3/1927 | McClaire | 132/246 |
| 1,643,226 | 9/1927 | Strabelle | 132/246 |
| 1,916,943 | 7/1933 | Beadle | 132/246 |
| 1,953,531 | 12/1933 | Casper . | |
| 2,066,709 | 1/1937 | Adams | 132/246 |
| 2,316,179 | 12/1941 | Moseley . | |
| 2,542,601 | 2/1951 | Van Cleef | 132/246 |
| 2,757,676 | 3/1953 | Hamilton . | |
| 2,953,827 | 9/1953 | Patterson . | |
| 3,471,867 | 10/1969 | Kirchhoff . | |
| 3,751,769 | 8/1973 | Reiner . | |
| 4,513,760 | 4/1985 | Tihonovich . | |
| 5,115,825 | 5/1992 | Kuhn . | |
| 5,167,245 | 12/1992 | Harriett . | |

FOREIGN PATENT DOCUMENTS

| | | | |
|---|---|---|---|
| 805423 | 5/1951 | Germany | 132/273 |

*Primary Examiner*—John G. Weiss

[57] ABSTRACT

A hair accessory includes first and second compressible flexible holder arms received about a bendable wire. A central joint member is located between the first and second holder arms on the wire and has a dimension which is at least as great as the dimension of the first and second holder arms. End members are located on the wire at the outer ends of the holder arms. The holder arms, central joint member, and end members are retained on the wire such as by bending the tips of the wire. The hair device can be used to create and maintain a number of different hair styles, such as for example, a bun, french twist, etc. or can be used as a headband, simply by bending, twisting or reconfiguring the hair device.

25 Claims, 1 Drawing Sheet

HAIR HOLDING DEVICE

FIELD OF THE INVENTION

The present invention relates generally to accessories for hair, and in particular to a hair holding device which can be used to create and maintain a wide variety of hair styles.

BACKGROUND OF THE INVENTION

Hair holding devices are well known accessories used to create a particular hair style and maintain the hair style for a period of time. Hair holding devices include bows, hair clips, bobbie pins, hair bands, and hair ties, among others. Examples of hair ties are shown in Reiner, U.S. Pat. No. 3,751,769, and Harriett, U.S. Pat. No. 5,167,245; while examples of hair clips and pins are shown in Moseley, U.S. Pat. No. 2,316,179 and Casper, U.S. Pat. No. 1,953,531.

While the above-described types of hair holding devices have achieved a certain amount of consumer acceptance, the usefulness of the known types of hair holding devices can be limited. That is, it can be difficult or inappropriate to use some of the above-identified hair holding devices for certain hair styles. For example, the hair ties shown in Reiner, U.S. Pat. No. 3,751,769, and Harriett, U.S. Pat. No. 5,167,245, do not have the strength and rigidity to create and maintain a roll or french twist; while the hair clips/bobbie pins shown in Moseley, U.S. Pat. No. 2,316,179 and Casper, U.S. Pat. No. 1,953,531 do not have the flexibility to create a bun. In general, it is believed that the hair holding devices which are commercially available can have structural limitations which make them inappropriate or difficult to use for a wide variety of popular hair styles. Thus, a consumer typically has to purchase a number of different types of hair devices to create different hair styles.

It is therefore believed that there is a demand in the market for a single hair holding device which can be used to create and maintain a wide variety of hair styles.

SUMMARY OF THE INVENTION

The present invention provides a new and unique hair holding device which can create and maintain a wide variety of hair styles. Moreover, the hair holding device is simple and easy to use and relatively inexpensive and straightforward to manufacture and assemble.

The hair holding device of the present invention comprises a pair of tubular holder arms which are bendable about a central joint member. Each holder arm is formed from a sleeve or sheath of compressible, flexible material and is located along a bendable wire. The central joint member is also located along the wire and is disposed between the inner ends of the holder arms. End members can be located on the wire adjacent the outer ends of the holder arms. The central joint member and end members preferably comprise balls or beads having an axial bore to receive the wire. The tips of the wire can be bent to retain the holder arms, central joint member, and end members on the wire.

Preferably, the central joint member has a diameter which is at least as great as the diameter of the tubular holder arms. When the holder arms are located around a bunch of hair, the arms can be bent around the central joint member into essentially parallel relation to each other. The hair device can then be bent, twisted or reconfigured as necessary to create a wide variety of hair styles. Such a structure facilitates the use of the hair holding device for styling hair, conceals the hair device within the hair, and provides a device which is appropriate for a wide variety of hair styles.

As an example, to form a "bun", the hair is pulled or draped downwardly from the back of the user's head and the arms of the device are located around the hair in parallel relation to each other. The hair device is then twisted around the hair toward the scalp in a horizontal orientation. The device is then bent in a circle or loop such that the end members touch the central joint member. The end members are then inserted between the hair and the joint member, and bent or twisted around the joint member and/or arm members as necessary to retain the device in the hair. The hair can be fanned over the device if desired.

To create a "french twist", the hair is first pulled or draped to one side of the user's head. The holder arms of the device are located around the hair and the end members on the holder arms are twisted together to secure the hair device around the hair. The device is then twisted around the hair in a vertical orientation toward the scalp and retained with bobbie pins if necessary. The hair can be fanned slightly to conceal the hair holding device.

Using the techniques described above, the hair holding device of the present invention can also be used to form a variety of other hair styles, such a "cascade", "chignon", "roll" "plume", etc., or can be used simply as a headband. Thus, the present invention provides a hair holding device which can create and maintain a wide variety of hair styles, is simple and easy to use, and which is relatively inexpensive and straightforward to manufacture and assemble.

DETAILED DESCRIPTION OF THE PREFERRED EMBODIMENT

Figure 1:
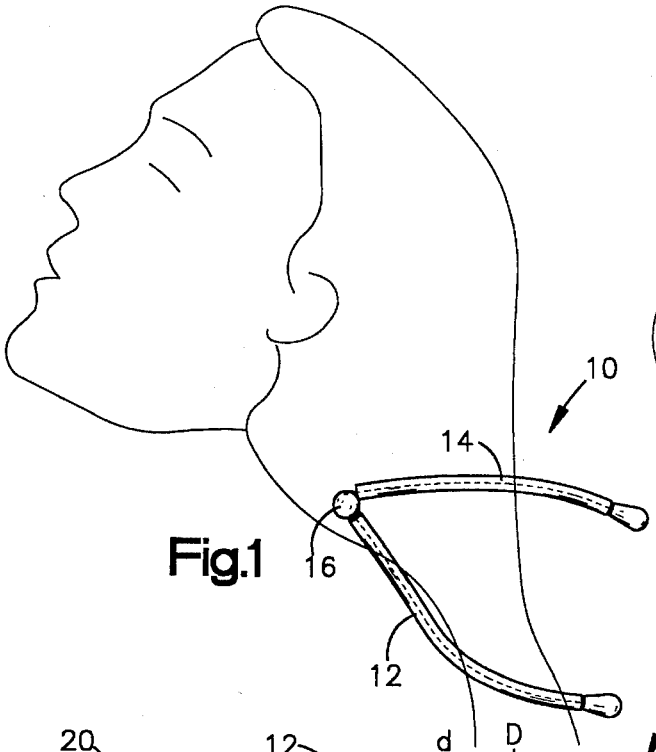
FIG. 1 is a perspective schematic view illustrating, a hair holding device constructed according to the principles of the present invention, and a first method of use of the hair holding device.
Figure 2:
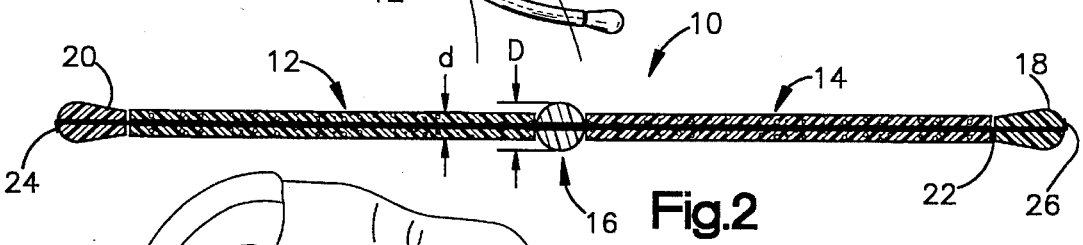
FIG. 2 is a perspective view, in section, of the hair holding device of Figure 1.

Referring to the drawings, and initially FIGS. 1 and 2, a hair holding device constructed according to the principles of the present invention is indicated generally at 10. The hair holding device includes first and second flexible holder arm members, indicated generally at 12, 14, extending outwardly from a central joint member, indicated generally at 16. The hair holding device terminates at opposite end members 18 and 20. The hair holding device can be formed out of numerous types of materials using conventional manufacturing techniques.

In particular, the arm members 12, 14 of the hair holding device preferably comprise tubular sheaths or sleeves of flexible, compressible material, for example neoprene. Each arm member has a narrow axial bore (unnumbered) formed therein. The arm members can be formed from a single sheath or sleeve of material, which is then cut appropriately, and preferably, into equal lengths. The dimensions of the holder arms can vary, but are preferably each about 7 inches long and one-half inch to an inch in diameter, such that the device can be easily used but is relatively unobtrusive on the head of the wearer.

Each arm member is received on a centrally-extending wire 22. Wire 22 is of a gauge or thickness which allows a certain amount of bendability and flexibility, but which has a tensile strength which allows repeatable bending and twisting without breaking. Preferably, the gauge of the wire is between 8 and 16. The wire also fits fairly snugly within the axial bore formed in the arm members. The wire is cut so as to be slightly longer than the holder arms, central joint member, and end members, as should be apparent from the accompanying figures.

The central joint member 16 is located intermediate to and adjacent the inner ends of arm members 12 and 14 at approximately the middle point along the wire. The central joint member preferably comprises a plastic ball or bead with an axial bore (unnumbered) dimensioned to freely receive wire 22. The joint member 16 has an outer diameter "D" which is preferably at least as great as the diameter "d" of the holder arms 12, 14, as will be explained herein in more detail.

The end members 18, 20 are located on wire 22 adjacent to the distal outer ends of each arm member 12, 14. Each end member also preferably comprises a plastic ball or bead with an axial bore (unnumbered) dimensioned to freely receive wire 22. To retain the holder arms 12, 14, the joint member 16, and the end members 18, 20 on the wire 22, the ends 24, 26 of the wire can be bent over at the tip, or otherwise have some sort of conventional fastener (e.g., a small bead or glue ball).

The assembly of the hair holder device can be accomplished in a simple and relatively inexpensive manner. First, end member 18 can be located on the wire 22, followed by sleeve 14, central joint member 16, sleeve 12, and the other end member 20. The distal ends 24, 26 of the wire can then be bent as described previously to retain the assembly on the wire.

Figure 3:
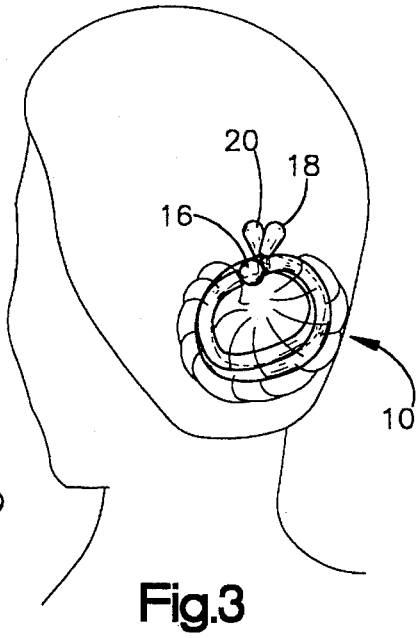
FIG. 3 is a further schematic illustration of the first method of use for the hair holding device shown in FIG. 1.

The hair device of the present invention can be simply and easily used to create various hair styles. For example, the hair device can be used to form a bun. As illustrated in FIGS. 1 and 3, the head is initially tilted straight backwards and the hair is pulled or allowed to flow in a generally downward direction. The arms 12, 14 of the hair device 10 are then spread apart, and located around a bunch of hair toward the end of the hair (FIG. 1). The arms 12, 14 are then brought together. The dimensions of the tubular arm members and the central joint member are such that the tubular arm members extend essentially parallel to each other when they are bent around the joint member.

The hair device 10 is then twisted upwardly in a generally horizontal direction toward the scalp, curling the hair, until the hair device touches the scalp. The arms of the hair device are then grasped and the hair device is formed into a circle or loop, with the end members 18, 20 being brought together and meeting central joint member 16 (FIG. 3). The end members 18, 20 are then pulled through between the joint member 16 and the hair. The end members 18, 20 can then be pulled apart and bent outwardly and twisted as necessary around the joint member 16 aM/or holder arms 12, 14 to retain the hair device on the head. The hair can then be fanned over the hair device to entirely conceal the hair device.

The relatively thin arm members and generally parallel structure of the holding device facilitates creating the hairstyle and concealing the hair device within the hair. Although typically not necessary with this hair style, bobbie pins or other devices can be used if desired to retain the hair device within the hair.

Figure 4:
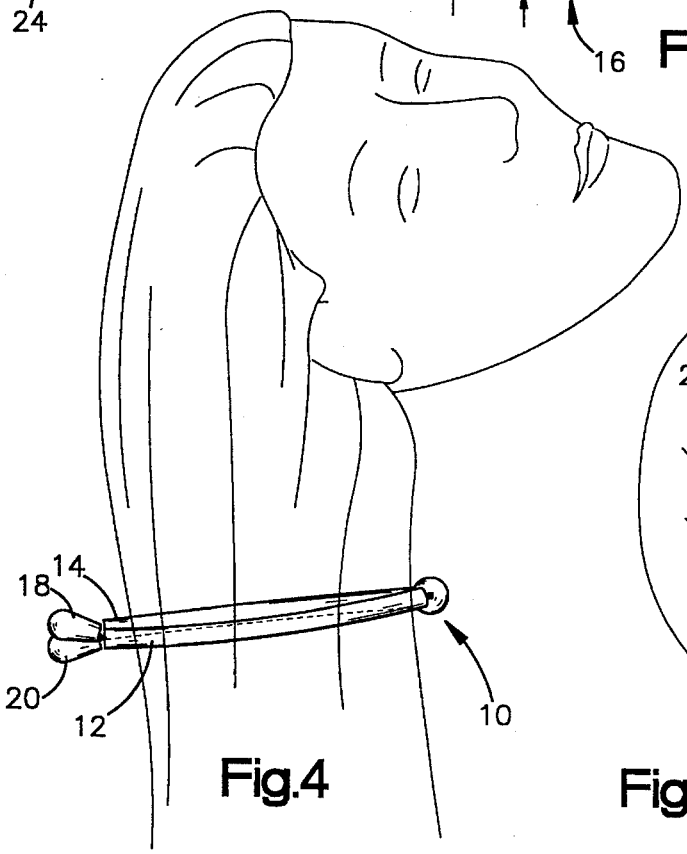
FIG. 4 is a schematic illustration of a second method of use for the hair holding device of FIG. 1.
Figure 5:
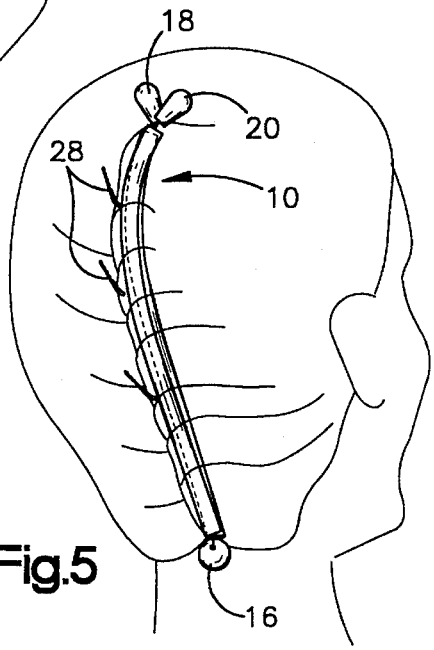
FIG. 5 is a another schematic illustration of the second method of use for the hair holding device shown in FIG. 4.

The hair device can also be used to easily form a "french twist." As illustrated in FIGS. 4 and 5, the head is tilted backwards and to the side such that the hair flows or is pulled generally to the side and downwardly. The hair device 10 is opened and the arms 12, 14 are located on either side of the hair (FIG. 4). The end members 18, 20 are then brought together and the end members are twisted together to secure the hair device around the hair. Again, the dimensions of the central joint member 16 and arm members 12, 14 are such that the arm members are essentially parallel to each other around the hair. The hair device 10 is then twisted in a generally vertical orientation toward the scalp, curling the hair, with the central joint member 16 toward the nape of the neck (FIG. 5). Bobbie pins 28 can then inserted at appropriate locations along the hair device to secure the hair device in place. The hair can then be fanned over the hair device as necessary.

Using the techniques described above, the hair device of the present invention can be used to easily create and maintain a variety of different hair styles. For example, the hair device can be used to form a roll, a "bun", a "chignon", a "plume", or a "cascade", among other hair styles simply by bending, twisting and reconfiguring the hair device as necessary. The hair device can also be used simply as a headband by locating the hair device around the hair with the central joint member at the nape of the neck, and bringing the arm members together and twisting the end members together at the top of the head. Thus, as described above, the hair device of the present invention provides a hair accessory which is simple and easy to use, relatively inexpensive and straightforward to manufacture and assemble, and can create and maintain a wide variety of hair styles.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A hair accessory, comprising:

a first compressible flexible holder arm, a second compressible flexible holder arm, a joint member in the form of a bead disposed between and interconnecting an inner end of the first holder arm and an inner end of the second holder arm, said first and second holder arms extending outwardly away from diametrically opposite sides of said joint member, a first end member disposed at an outer end of the first holder arm, and a second end member disposed at an outer end of the second holder arm, wherein said holder arms are separately movable and bendable into selected configurations from a position where the entire length of the first and second holder arms are substantially co-linear with one another, to a position where the entire length of the first and second holder arms are substantially parallel with one another.

2. The hair accessory as in claim 1, wherein said first holder arm has substantially the same configuration as said second holder arm.

3. The hair accessory as in claim 2, wherein said first and second holder arms have a tubular configuration.

4. The hair accessory as in claim 3, wherein said joint member has a peripheral dimension which is at least as large as the outer diameter of said first and second holder arms.

5. The hair accessory as in claim 4, further including a bendable wire extending between and interconnecting the first and second holder arms, the joint member, and the first and second end members.

6. The hair accessory as in claim 5, wherein said joint member has an internal straight bore which freely receives said wire.

7. The hair accessory as in claim 6, wherein said first and second holder arms each have an internal bore which freely receives said wire.

8. The hair accessory as in claim 7, wherein said first and second end members each have an internal bore which freely receives said wire.

9. The hair accessory as in claim 5, wherein said joint member and said first and second end members each comprise a bead.

10. A hair accessory, comprising:

a bendable, flexible wire having a first end, a second end, and a wire length extending between said first end and said second end, a first end member receiving said wire and located proximate said first end, a first flexible compressible sheath receiving said wire and having an outer end located adjacent said first end member, a joint member receiving said wire in a straight bore formed through said joint member, said joint member being located adjacent an inner end of said first sheath such that said first sheath extends outwardly away from said joint member on a first side thereof, a second flexible compressible sheath, substantially similar to said first sheath, receiving said wire and having an inner end located adjacent said joint member such that said second sheath extends outwardly away from said joint member on a second side thereof opposite from said first side, and a second end member receiving said wire and located adjacent an outer end of said second sheath and proximate said second end of said wire.

11. The hair accessory as in claim 10, wherein said joint member has a peripheral configuration with a dimension which is at least as great as a peripheral configuration of each sheath.

12. The hair accessory as in claim 11, wherein said joint member comprises a bead having a central bore extending diametrically through said bead which freely receives said wire.

13. The hair accessory as in claim 12, wherein each of said first and second end members comprises a bead having a central bore extending diametrically through said bead which freely receives said wire.

14. The hair accessory as in claim 10, further including a first fastener at said first wire end and a second fastener at said second wire end for retaining said first and second end members, said first and second sheaths, and said joint member on said wire.

15. The hair accessory as in claim 10, wherein said wire is formed in one piece.

16. The hair accessory as in claim 10, wherein each of said first and second sheaths has an inner end and an outer end, said joint member is adjacent the inner end of the first sheath and the inner end of said second sheath, said first end member is adjacent the outer end of the first sheath and said second end member is adjacent the outer end of the second sheath.

17. A hair accessory, comprising:

a flexible bendable wire having first and second wire ends, and a wire length extending between the first and second ends, a first flexible covering extending along a first portion of the wire length and freely received thereon, a second flexible covering extending along a second portion of the wire length and freely received thereon, a joint member on said wire intermediate said first and second coverings and freely received on said wire, a first end member on said wire adjacent said first wire end, and a second end member on said wire adjacent said second wire end.

18. The hair accessory as in claim 17, wherein each of the first and second coverings comprising a tubular sheath formed from compressible material with a central bore receiving a respective wire portion.

19. The hair accessory as in claim 17, wherein said joint member has a peripheral configuration with a dimension which is at least as great as the peripheral dimension of each covering.

20. The hair accessory as in claim 19, wherein the joint member comprises a bead.

21. The hair accessory as in claim 19, wherein each of said first and second end members comprises a bead.

22. The hair accessory as in claim 19, further including a first fastener at said wire end, and a second fastener at said second wire end for retaining said first and second coverings, first and second end members, and said joint member on said wire.

23. The hair accessory as in claim 19, wherein said wire is formed in one piece.

24. The hair accessory as in claim 19, wherein each of said first and second coverings has an inner end and an outer end, said joint member is adjacent an inner end of the first covering and an inner end of the second covering, said first and second coverings extending away from said joint member in opposite directions from one another, said first end member is adjacent the outer end of the first covering and said second end member is adjacent the outer end of the second covering.

25. The hair accessory as in claim 19, wherein the wire is at least 14 inches long.

* * * * *